US009695713B2

(12) United States Patent
Eshak et al.

(10) Patent No.: US 9,695,713 B2
(45) Date of Patent: Jul. 4, 2017

(54) DAMPING DESIGN TO REDUCE VIBRATORY RESPONSE IN THE TURBINE EXHAUST MANIFOLD CENTERBODY

(71) Applicant: Siemens Energy, Inc., Orlando, FL (US)

(72) Inventors: Daniel M. Eshak, Orlando, FL (US); Yevgeniy P. Shteyman, West Palm Beach, FL (US); John Giaimo, Palm Beach Gardens, FL (US); George J. Obranic, Jr., Loxahatchee, FL (US); Sudeep Bosu, Charlotte, NC (US)

(73) Assignee: SIEMENS ENERGY, INC., Orlando, FL (US)

( * ) Notice: Subject to any disclaimer, the term of this patent is extended or adjusted under 35 U.S.C. 154(b) by 350 days.

(21) Appl. No.: 14/619,637

(22) Filed: Feb. 11, 2015

(65) Prior Publication Data

US 2016/0076397 A1 Mar. 17, 2016

Related U.S. Application Data

(60) Provisional application No. 62/050,242, filed on Sep. 15, 2014.

(51) Int. Cl.

| | |
|---|---|
| ***F01D 25/04*** | (2006.01) |
| ***F01D 25/30*** | (2006.01) |
| ***F01D 25/16*** | (2006.01) |

(52) U.S. Cl.

CPC ..... *F01D 25/30* (2013.01); *F01D 25/164* (2013.01); *F01D 25/04* (2013.01); *F05D 2250/281* (2013.01); *F05D 2260/96* (2013.01)

(58) Field of Classification Search

CPC ..... F01D 25/04; F01D 25/30; F01D 25/164; F05D 2250/281; F05D 2260/96; F05D 2260/961; F05D 2260/962; F05D 2260/963; F05D 2260/964

USPC ..... 415/119

See application file for complete search history.

(56) References Cited

U.S. PATENT DOCUMENTS

| | | | | |
|---|---|---|---|---|
| 2,710,523 A * | 6/1955 | Thompson | F01D 25/30 | 415/119 |
| 4,848,803 A * | 7/1989 | Bachmann | F16L 59/21 | 285/114 |
| 5,669,812 A * | 9/1997 | Schockemoehl | F01D 25/30 | 285/187 |
| 6,122,917 A * | 9/2000 | Senior | F23R 3/002 | 165/908 |
| 2013/0149107 A1* | 6/2013 | Munshi | F01D 25/12 | 415/116 |

(Continued)

OTHER PUBLICATIONS

Nelson Stud Welding, Inc., "Stud Welding—CPL Partially Threaded Studs", Nelson Stud Welding, Inc., Standard Stock Products Catalog, Feb. 2004, p. 22.

*Primary Examiner* — William McCalister

(57) ABSTRACT

Disclosed are a system for damping vibrations of a gas turbine exhaust and a method to damp vibrations of a gas turbine exhaust. The system includes a turbine exhaust cylinder connected to a turbine exhaust manifold establishing a fluid flow path, the fluid flow path including an inner and an outer flow path. A damping blanket damps the vibrations and is coupled to a surface of the inner flow path via a constraining layer clamped by a plurality of studs.

20 Claims, 4 Drawing Sheets

(56) References Cited

U.S. PATENT DOCUMENTS

| | | | | |
|---|---|---|---|---|
| 2013/0149121 | A1* | 6/2013 | Munshi | F01D 25/14<br>415/178 |
| 2013/0251510 | A1* | 9/2013 | Runyan | F01D 25/00<br>415/119 |

* cited by examiner

DAMPING DESIGN TO REDUCE VIBRATORY RESPONSE IN THE TURBINE EXHAUST MANIFOLD CENTERBODY

CROSS-REFERENCE TO RELATED APPLICATIONS

This application claims the benefit of the priority date of U.S. Provisional Patent Application Ser. No. 62/050,242, titled "DAMPING DESIGN TO REDUCE VIBRATORY RESPONSE IN THE TURBINE EXHAUST MANIFOLD CENTERBODY", filed Sep. 15, 2014.

BACKGROUND

1. Field

The present application relates to gas turbines, and more particularly to a system and method to damp vibrations of a gas turbine exhaust system.

2. Description of the Related Art

The turbine exhaust cylinder and the turbine exhaust manifold are coaxial gas turbine casing components connected together establishing a fluid flow path for the gas turbine exhaust. The fluid flow path includes an inner flow path and an outer flow path defined by an inner diameter delimiting an outer surface of the inner flow path and an outer diameter delimiting an inner surface of the outer flow path, respectively. Struts are arranged within the fluid flow path and serve several purposes such as supporting the flow path and providing lubrication for the turbine and rotor bearing. The exhaust flow around the struts causes vibrations of the inner and outer diameter of the turbine exhaust cylinder and the turbine exhaust manifold due to vortex shedding. Vortex shedding are vibrations induced as the exhaust flows past the struts, where the struts partially obstruct the flow of the exhaust in the inner flow path. These vibrations are a potential contributor to damage occurring on the flow path of the turbine exhaust manifold and the turbine exhaust cylinder. This damage to the casing components may require replacement or repair.

SUMMARY

Briefly described, aspects of the present disclosure relates to a system for damping vibrations of a gas turbine exhaust manifold and a method to damp vibrations of a gas turbine exhaust.

A first aspect of provides a system for damping vibrations of a gas turbine exhaust. The casing arrangement includes a turbine exhaust manifold connected to the turbine exhaust cylinder establishing a fluid flow path, the fluid flow path including an inner and an outer flow path, a plurality of studs coupled to the inner surface of the inner flow path and oriented radially inward, a damping blanket effective to damp vibrational amplitude, and a constraining layer clamped to the damping blanket by the studs. The clamping layer is clamped with sufficient clamping pressure to provide frictional damping of vibrations of the gas turbine exhaust.

A second aspect of provides a method to damp vibrations of a gas turbine exhaust. The method includes disposing a damping blanket against a flow path of the gas turbine, coupling a plurality of studs to an inner surface of the inner flow path such that the damping blanket is arranged on the plurality of studs, and clamping a constraining layer with sufficient clamping pressure to the damping blanket with the plurality of studs providing frictional damping of vibrations of the gas turbine exhaust. The flow path is defined by an inner and an outer flow path and is bounded radially inward by an outer surface of the inner flow path and radially outward by an inner surface of the outer flow path.

DETAILED DESCRIPTION

To facilitate an understanding of embodiments, principles, and features of the present disclosure, they are explained hereinafter with reference to implementation in illustrative embodiments. Embodiments of the present disclosure, however, are not limited to use in the described systems or methods.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

Damage to gas turbine casing components is an issue that may be caused by vibrations within the inner and outer flow path of the gas turbine exhaust system. In particular, vibrations such as panel modes and/or critical modes are excited due to flow induced vibrations. Panel modes are mode shapes of panels. In structural dynamics, mode shapes are three-dimensional deformation shapes of an elastic component. Critical modes are mode shapes that couple with the forcing function or energy input and are especially problematic because they may create damage to the casing components, particularly to the flow path of the gas turbine.

An approach to avoid component damage to the casing components caused by vibrations would be to introduce a damping mechanism to damp the problematic vibrations and transfer the energy associated with these vibrations to heat energy. This type of damping mechanism is known as a frictional damper such that the dynamic energy of the vibration is transferred to heat energy by means of friction. The damping mechanism may reduce the amplitude of the vibrations lessening their severity and capacity to damage the casing components. Existing insulation positioned on the inner surface of the inner flow path used to insulate components outside of the flow path against the heat of the flow path may provide additional functionality as the damping mechanism. The layers of insulation may be preloaded, or compressed, a predefined amount to provide sufficient damping to damp the unwanted vibrations while not disintegrating the insulation.

Figure 1:
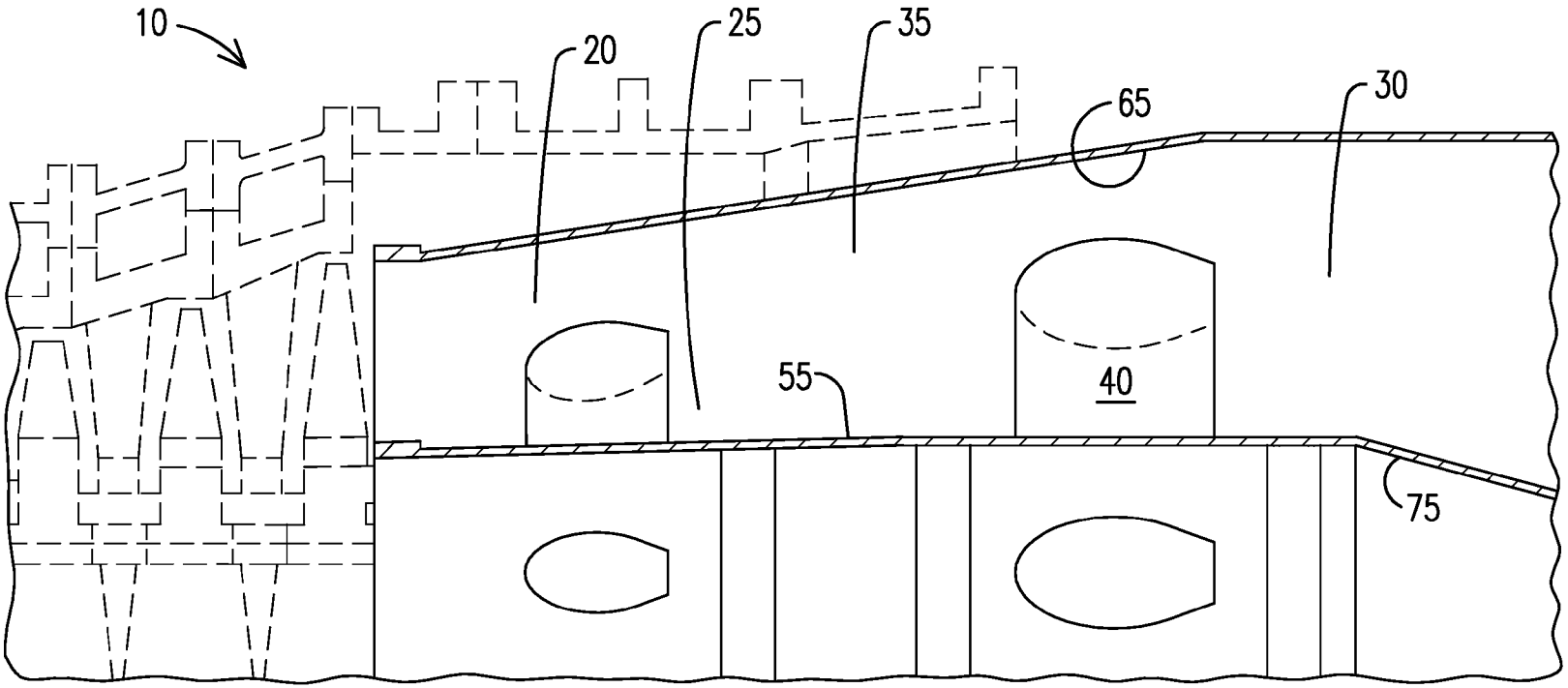
FIG. 1 illustrates a longitudinal view of the exhaust system of a gas turbine.

FIG. 1 illustrates a longitudinal view of the exhaust system (10) of a gas turbine. The turbine exhaust system (10) is disposed in the aft portion of the turbine section of the gas turbine and includes a turbine exhaust cylinder (20) and a turbine exhaust manifold (30). The turbine exhaust manifold (30) is connected downstream from the turbine exhaust cylinder (20) and establishes a fluid flow path, the fluid flow path includes an inner flow path (25) and outer flow path (35). The fluid flow path is bounded radially inward by an outer surface (55) of the inner flow path and radially outward by an inner surface (65) of the outer flow path. Struts (40) are hollow tubes that may extend between the inner flow path (25) to the outer flow path (35).

Figure 2:
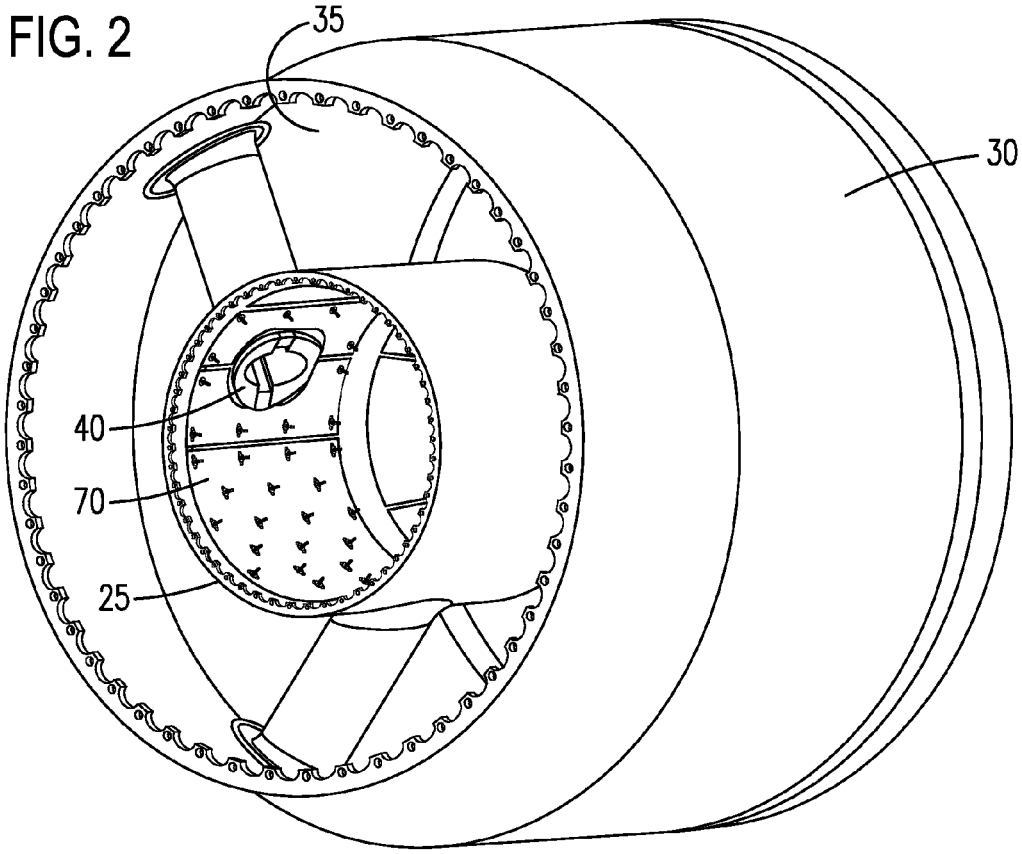
FIG. 2 illustrates a perspective view of the turbine exhaust manifold.

FIG. 2 illustrates a perspective view of the turbine exhaust manifold (30). In the shown embodiment, a damping mechanism (70) is coupled to the inner surface (75) of the inner flow path and is positioned axially and circumferentially along the flow path. As previously stated, adding a damping mechanism (70) may be used to damp the amplitude of the undesired vibrations. Within the turbine exhaust manifold (30), the inner flow path (25) and the outer flow path (35) are shown.

Figure 3:
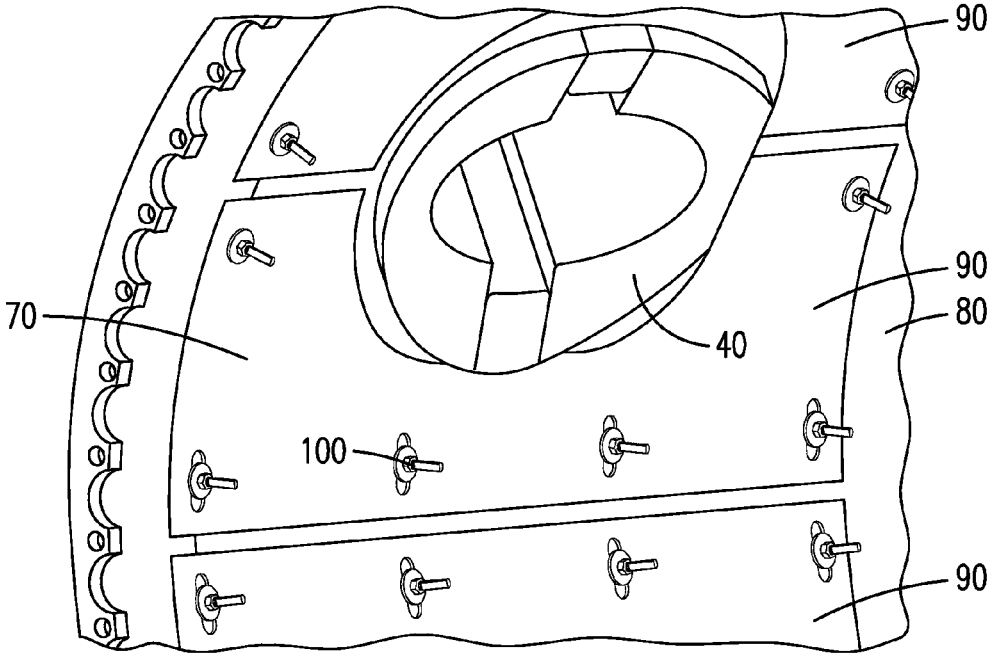
FIG. 3 illustrates a front view of the damping mechanism.

A front view of an embodiment of the damping mechanism (70) is illustrated in FIG. 3. In the figure, the damping mechanism (70) is embodied as a frictional damper including a damping blanket (80) and a constraining layer clamped to the damping blanket (80) by a plurality of studs (100). From this view, it may be seen that the constraining layer comprises a backing plate (90) divided into multiple panels, each panel secured to the damping blanket (80) by the plurality of studs (100). For illustrative purposes, the constraining layer is described hereinafter as the backing plate (90) or the backing plate panels (90). The backing plate (90) is positioned radially inward of the damping blanket (80).

Figure 4:
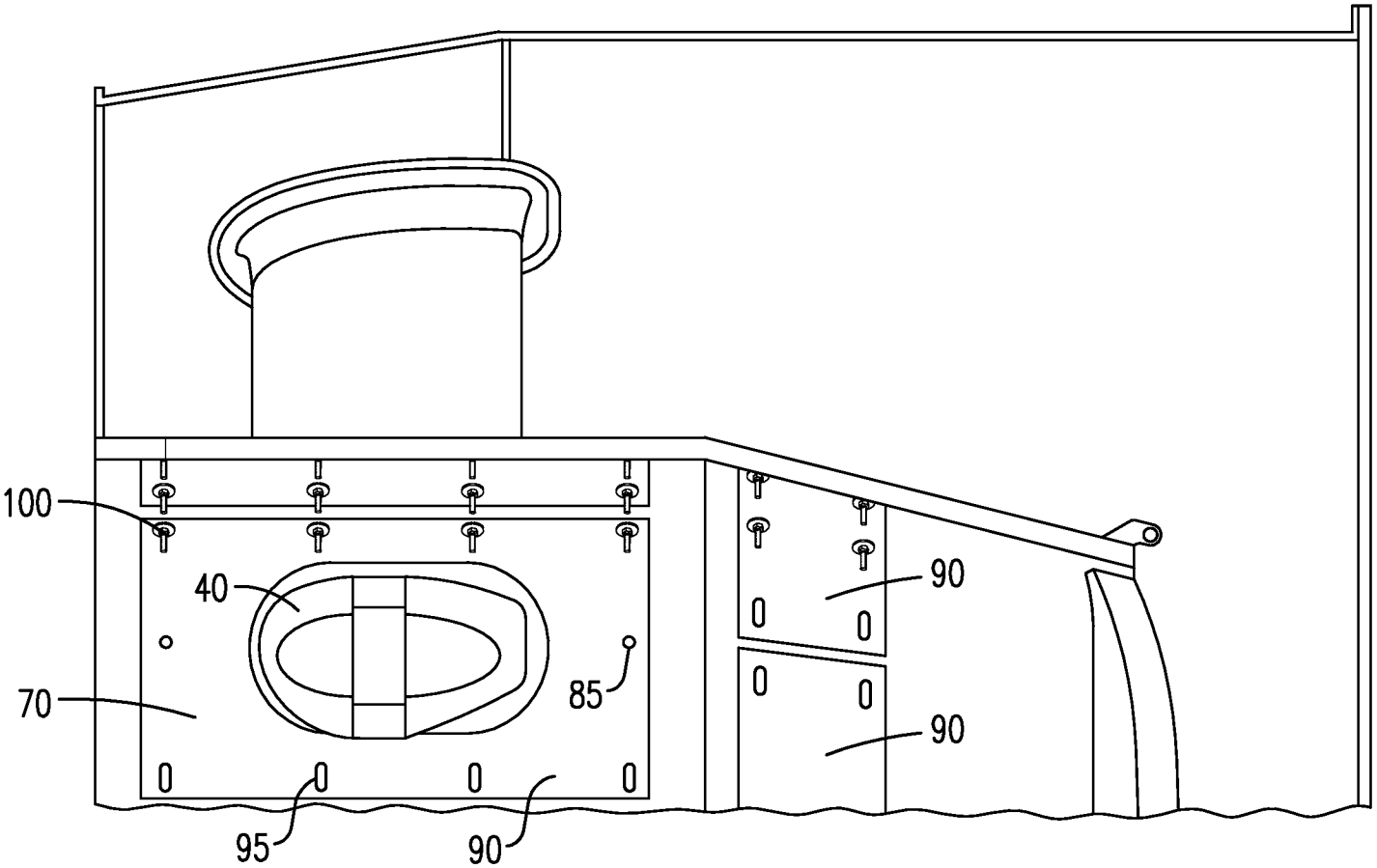
FIG. 4 illustrates a longitudinal view of the exhaust system flow path.

The backing plate panels (90) may be positioned both in the forward portion of the turbine exhaust manifold (30) and the aft position of the turbine exhaust manifold (30), with reference to the fluid flow direction, and around the struts (40) as seen in FIG. 4. In the shown embodiment, the backing plate panels (90) circumferentially cover the inner surface (75) of the inner flow path. The placement of the backing plate panels (90) may be strategically determined to damp specific panel modes. Based on calculations of predicted displacement, backing plate panels (90) may be strategically placed to target areas of higher displacement. Depending on the number of struts (40) within the gas turbine exhaust system (10), a non circumferential covering of the backing plate panels (90) may be envisioned.

The backing plate panels (90) should be sufficiently rigid in order to maintain a steady compression of the damping blanket. A sufficiently rigid material used as the backing plate may be steel. A thickness of the material may contribute to the rigidity of the backing plate panels (90) where each backing plate panel (90) may include a thickness in the range of 3.0 mm to 13 mm. Using a thickness in this range facilitates the assembly of the backing plate panels (90) as the weight of each backing plate panel (90) would be manageable. Additionally, the size of the backing plate panels (90), height and width, may be decreased to improve ease of assembly and minimize relative thermal growth between adjacent studs.

Figure 6:
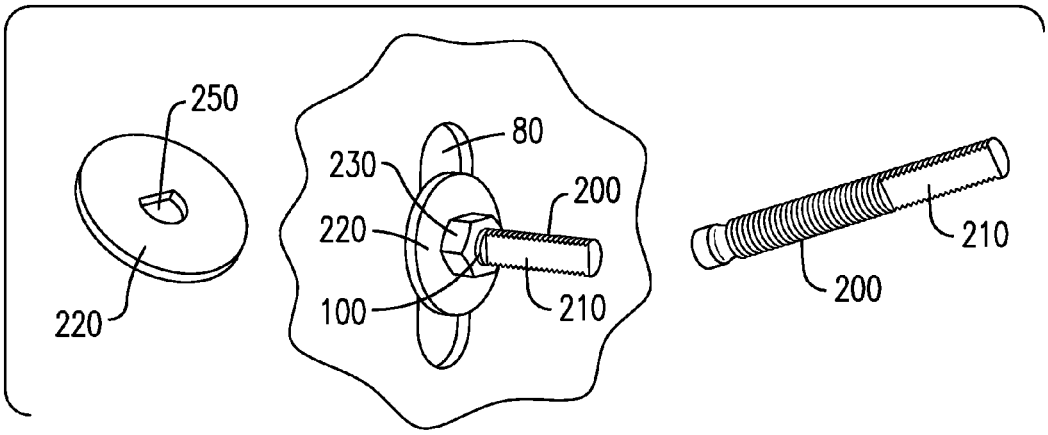
FIG. 6 illustrates a perspective view of a damping system including a stud protruding through the damping system.

As shown in FIG. 4, the backing plate panels (90) include a plurality of holes (85, 95) in order to attach and position the backing plate panels (90) using the plurality of studs (100). The plurality of holes (85, 95) may include circular positioning holes (85) and/or elongated holes (95). The circular positioning holes (85) may be used to position the backing plate panel (90) on the surface of the flow path. The backing plate panel (90) may be secured using a welded radial rod (200), as shown in FIG. 6, installed through the circular positioning hole (85). Welded radial threaded rods (200) are also installed through the elongated holes (95) to further secure the backing plate panels (90). The elongated holes (95) permit the radial threaded rod (200) to expand, and slide within the elongated hole (95), due to thermal expansion of the backing plate panel (90).

Figure 5:
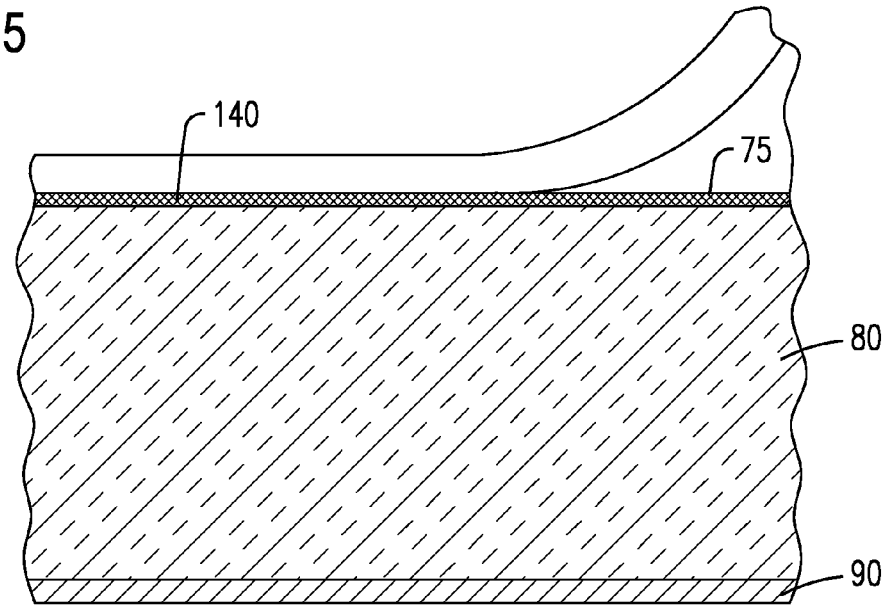
FIG. 5 illustrates a cross sectional view of a damping system.

FIG. 5 illustrates a cross sectional view of an embodiment of the damping blanket (80) and a constraining layer. The damping blanket (80) may be embodied as insulation, and the constraining layer may be embodied as a backing plate (90) as shown. Additionally, a mesh layer (140) may be disposed between the inner surface (75) of the inner flow path and the damping blanket (80).

The mesh layer (140) increases the adhesion to the flow path of the damping mechanism (70) as well as providing additional frictional damping of the vibratory panel modes of the gas turbine exhaust system (10). As is true of a frictional damper, heat is generated by the friction created between the insulation and the mesh layer (140). In order to effectively provide adhesion and frictional damping the mesh layer may (140) include a material with a bidirectional overlap on its surface or it may be woven. The mesh layer (140) may comprise metal or foil and has a thickness in the range of 0.5 mm to 2.0 mm.

Insulation (80), and possibly a plurality of layers which including an outermost layer and an innermost layer, are embodied as the damping blanket (80). In the embodiment of FIG. 5, the outermost portion of the insulation (80) is coupled to the mesh layer (140) and the innermost portion of insulation (80) is coupled to the backing plate (90). As a result of the placement of the insulation (80) coupled to the inner surface (75) of the inner flow path via the mesh layer (140) in this embodiment, the insulation (80) would be circumferentially disposed around the inner surface (75) of the inner flow path.

The insulation used may be ceramic insulation. As an example, the thickness of the insulation may be approximately 75 mm. Various thicknesses may be used and are based on the insulation properties. After being compressed, or preloaded, the thickness of the insulation may be approximately 50 mm, a 33% compression. A compression in the range of 10-50%, based on insulation stiffness and initial thickness, would be effective to damp the undesired vibrations of the turbine exhaust manifold (30). An appropriate amount of compression depends on the insulation type. Ceramic insulation is appropriate for use in the gas turbine exhaust system (10) to keep the internal cavity and the bearing cool. However, the type of insulation used is not limited to ceramic insulation. Other types of insulation, such as foam and metal encapsulated, may be used provided that the insulation type could withstand temperatures in the ranges of 300° C. to 600° C. which is a typical temperature range that exists in the gas turbine exhaust system (10) in normal operation.

As shown in the embodiments of FIGS. 2-4 and 6, at least one stud (100) protrudes through the insulation (80) and is coupled to the inner surface (75) of the inner flow path. The coupling to the inner surface (75) of the inner flow path may be via the mesh layer (140). The stud (100) may comprise a radial rod (200). An end of a radial rod (200) is welded to the inner surface (75) of the inner flow path or the mesh layer (140) when the mesh layer (140) is disposed between the insulation (80) and the inner surface (75) of the inner flow path. The other end of the radial rod may include a semicircular end portion (210) which may protrude through an opening in the backing plate panel (90) and may be secured to the backing plate panel (90) with a corresponding semicircular washer (220) and a hex nut (230) as shown in FIG. 6.

An embodiment of a radial threaded rod (200) and its corresponding washer (220) is shown in FIG. 6. A commercially available radial threaded rod (200) such as that manufactured by NelsonStud Inc. may be used for the purpose of clamping the damping blanket (80) to the backing plate panel (90). The radial threaded rod (200) may include an end portion with a semicircular profile (210). A washer (220) including a semicircular cut out (250) would be used to mate with the semicircular end portion (210) of the radial threaded rod (200) in this embodiment. An advantage of using a semicircular radial threaded rod (200) and corresponding washer (220) is that the semicircular washer (220) would not be able to rotate on the radial rod preventing the hex nut (230) from loosening and/or falling off. The hex nut (230) may be tack welded to the washer (220) in order to further secure it. The plurality of studs (100) protruding through each backing plate panel (90) are spaced in order to maintain the attachment of the backing plate (90) to the inner surface (75) of the inner flow path while providing effective damping of the undesired vibrations. Additionally, heat affected zones may be avoided to prevent material degradation. The heat affected zones may be due to existing welds along the flow path due to flow path vibrations.

The system and corresponding method provides a way to provide effective damping of undesired vibrations in the critical areas of the turbine exhaust system flow path and decrease the critical mode response without compromising the components' structural integrity. Additionally, the damping scheme uses existing insulation such that the insulation has the dual functionality as an element in a frictional damper as well as offering protection of the inner cavity from the heat of the flow path.

Referring to FIGS. 1-6, a method to damp vibrations of a gas turbine is also provided. In an embodiment, a damping blanket (80) is disposed against a flow path of the gas turbine within the turbine exhaust system (10). A plurality of studs (100) may be coupled to the flow path and used to clamp a constraining layer (90) to the damping blanket (80) providing sufficient clamping pressure to provide frictional damping of vibrations of the gas turbine exhaust (10). In the embodiments shown in the Figures, the radial threaded rods (200) are welded to an inner surface (75) of the inner flow path (25).

Each of the plurality of studs (100) is disposed away from heat affected zones and spaced in order to effectively attach a backing plate (90) panel, as shown in the illustrated embodiments, and effectively damp the undesired vibrations. As mentioned previously, each stud (100) may comprise a radial threaded rod (200) which may be coupled to the inner surface (75) to the inner flow path (25) by welding. In order to secure the radial threaded rod (200) to the backing plate panel (90), a nut (230) and washer (220) may be used.

The damping blanket may be embodied as insulation (80) as shown in the illustrated embodiments. The insulation (80) may be coupled against the flow path along the inner surface (75) of the inner flow path (25) between the mesh layer (140) and the constraining layer. The insulation (80) may comprise segments and attach to existing attachment positions on flow path of the gas turbine.

The constraining layer may comprise a plurality of backing plate panels (90). The backing plate panels (90) may be disposed axially and/or circumferentially. The placement of the backing plate panels (90) may be determined based on calculations of predicted displacement. The backing plate panels (90) compress the damping blanket (80) to sufficiently damp the undesired vibrations while not disintegrating the material of the damping blanket (80).

In an embodiment, a mesh layer (140) is disposed between an inner surface (75) of the inner flow path (25) and the damping blanket (80). The mesh layer (140) may be attached to the damping blanket (80) via the plurality of studs (100). The plurality of studs (100) penetrates the mesh layer (140) through the holes in the mesh layer (140). Additionally, the mesh layer may be tack welded to the flow path surface at a plurality of locations.

While embodiments of the present disclosure have been disclosed in exemplary forms, it will be apparent to those skilled in the art that many modifications, additions, and deletions can be made therein without departing from the spirit and scope of the invention and its equivalents, as set forth in the following claims.

What is claimed is:

1. A system for damping vibrations of a gas turbine exhaust, comprising:

a turbine exhaust manifold connected to a turbine exhaust cylinder establishing a fluid flow path, the fluid flow path including an inner and an outer flow path;

a plurality of studs coupled to the inner surface of the inner flow path and oriented radially inward;

a damping blanket effective to damp vibrational amplitude; and a constraining layer clamped to the damping blanket by the studs, wherein the constraining layer is clamped with sufficient clamping pressure to provide frictional damping of vibrations of the gas turbine exhaust.

2. The system as claimed in claim 1, further comprising a mesh layer disposed between an inner surface of the inner flow path and the damping blanket effective to provide additional frictional damping.

3. The system as claimed in claim 2, wherein the thickness of the mesh layer is in a range of 0.5 mm to 2.0 mm.

4. The system as claimed in claim 2, wherein the mesh layer includes a material including a bidirectional overlap on the surface or a material that is woven.

5. The system as claimed in claim 2, wherein the damping blanket comprises insulation, wherein an outermost portion of the insulation is coupled to the mesh layer and an innermost portion of the insulation is coupled to the constraining layer.

6. The system as claimed in claim 5, wherein the constraining layer comprises a backing plate sufficient to compress the insulation to provide effective damping.

7. The system as claimed in claim 6, wherein the backing plate comprises a plurality of panels positioned radially inward of the damping blanket on the inner surface of the inner flow path and around a plurality of struts.

8. The system as claimed in claim 7, wherein the plurality of panels are spaced in order to damp panel modes generated in the inner flow path.

9. The system as claimed in claim 6, wherein the thickness of the backing plate is in a range of 3.0 mm to 13 mm.

10. The system as claimed in claim 9, wherein the backing plate comprises steel.

11. The system as claimed in claim 6, wherein each stud includes a welded radial rod secured by a hex nut and a washer, wherein a first end of the welded radial rod is welded to the inner surface of the inner flow path, and wherein a second end of the welded radial rod protrudes through the backing plate.

12. The system as claimed in claim 11, wherein a portion of the welded radial threaded rod includes a semicircular cross section, wherein the welded radial threaded rod is secured to the backing pate with a corresponding semi-circular washer and a hex nut.

13. The system as claimed in claim 1, wherein the plurality of studs are spaced effective to maintain attachment while providing effective damping of vibrations of the turbine exhaust manifold.

14. A method to damp vibrations of a gas turbine exhaust, comprising:

disposing a damping blanket against a fluid flow path of the gas turbine, the fluid flow path including an inner and an outer flow path;

coupling a plurality of studs to an inner surface of the inner flow path such that the damping blanket is arranged on the plurality of studs; and clamping a constraining layer with sufficient clamping pressure to the damping blanket with the plurality of studs providing frictional damping of vibrations of the gas turbine exhaust, wherein the flow path is bounded radially inward by an outer surface of the inner flow path and radially outward by an inner surface of the outer flow path.

15. The method as claimed in claim 14, wherein the coupling further comprises placing each of the plurality of studs at locations on the inner surface of the inner flow path of the gas turbine away from heat affected zones due to an existing weld.

16. The method as claimed in claim 15, wherein each stud includes a welded radial rod and wherein each radial threaded rod is welded to the inner surface of the inner flow path.

17. The method as claimed in claim 16, wherein the clamping further comprises welding the radial rod to the flow path, and securing the welded radial rod by a hex nut and a washer.

18. The method as claimed in claim 14, further comprising determining placement of the constraining layer based on calculations of predicted displacement, and wherein the constraining layer further comprises a plurality of backing panels.

19. The method as claimed in claim 17, further comprising compressing the insulation to provide effective damping by the constraining layer.

20. The method as claimed in claim 14, further comprising disposing a mesh layer between an inner surface of the inner flow path and the damping blanket, and wherein the mesh layer is effective to provide additional frictional damping.

* * * * *